US010213681B1

(12) United States Patent
Coombe

(10) Patent No.: US 10,213,681 B1
(45) Date of Patent: Feb. 26, 2019

(54) COUNTING AND SCORING DEVICE

(71) Applicant: Alan Coombe, Ellenville, NY (US)

(72) Inventor: Alan Coombe, Ellenville, NY (US)

( * ) Notice: Subject to any disclaimer, the term of this patent is extended or adjusted under 35 U.S.C. 154(b) by 233 days.

(21) Appl. No.: 15/330,499

(22) Filed: Sep. 28, 2016

Related U.S. Application Data

(63) Continuation-in-part of application No. 14/611,550, filed on Feb. 2, 2015, now abandoned.

(51) Int. Cl.
*A63F 11/00* (2006.01)

(52) U.S. Cl.
CPC ..... *A63F 11/0051* (2013.01)

(58) Field of Classification Search
CPC ..... A63F 9/00; A63B 71/00
USPC ..... 273/148 R
See application file for complete search history.

(56) References Cited

U.S. PATENT DOCUMENTS 2,131,132 A * 9/1938 Alderman ..... A63F 1/06 116/223
2,137,013 A * 11/1938 Bradley ..... G06M 3/021 222/14
2,242,699 A * 5/1941 Flader ..... G06M 1/241 116/337
2,444,570 A * 7/1948 Lawrence et al. .... G06M 1/083 235/1 C
2,920,816 A * 1/1960 Greenhow ..... G06M 1/243 235/1 C
2,996,241 A * 8/1961 Hoffmann ..... G06M 1/343 235/1 C
3,069,083 A * 12/1962 Haydon ..... G06M 1/143 235/136
3,229,907 A * 1/1966 Shatas ..... G06M 1/22 235/1 R
3,458,127 A * 7/1969 Hermann ..... G01C 22/00 235/117 R
3,468,535 A * 9/1969 Obst ..... A63B 63/00 248/188.4
3,722,461 A * 3/1973 Forman ..... G06M 1/02 116/223
3,924,399 A * 12/1975 Robinson ..... G04C 17/0008 368/235
4,912,307 A * 3/1990 Shade ..... G06C 1/00 116/324
5,482,275 A * 1/1996 Grinoch ..... A63F 1/06 273/142 HA (Continued)

*Primary Examiner* — John E Simms, Jr.
*Assistant Examiner* — Dolores Collins
(74) *Attorney, Agent, or Firm* — Sandra M. Kotin

(57) ABSTRACT

A counting and scoring device has a housing with its interior divided into right and left chambers by a vertical partition. A wheel is vertically mounted and rotatable within each chamber of the housing using a threaded bolt and hexagonal nut. The wheels have a plurality of flat outer surfaces on which to display indicia in the form of the numerals 0 through 9 viewed through a three-sided window on each side of the top portion of the housing. Ball bearings activated by a compression spring within a tapered opening in the partition are in contact with depressions in the inside walls of the wheels below each flat surface so that as each wheel rotates a numeral is centered in a window. A hexagonal cavity within the hub portion enables the left wheel to act as a wrench to tighten the hexagonal nut when assembling the device.

11 Claims, 4 Drawing Sheets

(56) References Cited

U.S. PATENT DOCUMENTS

| | | | | | |
|---|---|---|---|---|---|
| 5,574,268 | A * | 11/1996 | Herman | G06M 1/083 | 116/223 |
| 5,762,334 | A * | 6/1998 | Kosi | G06C 3/00 | 273/148 R |
| 7,584,712 | B2 * | 9/2009 | Lu | A61M 15/009 | 116/284 |
| 7,650,883 | B2 * | 1/2010 | Scarrott | A61M 15/0065 | 128/200.23 |
| 7,757,688 | B2 * | 7/2010 | Scarrott | A61M 15/0065 | 116/307 |
| 8,224,406 | B2 * | 7/2012 | Champion | G06F 1/16 | 361/679.09 |
| 8,607,725 | B2 * | 12/2013 | Degirmenci | A63B 71/0672 | 116/222 |
| 2003/0227451 | A1 * | 12/2003 | Chang | G09G 3/00 | 345/211 |

* cited by examiner

COUNTING AND SCORING DEVICE

This application is a continuation-in-part of application Ser. No. 14/611,550 filed on Feb. 2, 2015, which is currently pending.

FIELD OF THE INVENTION

The instant invention relates to a small portable device to be used to count points, record the score in a game, or exhibit numerals associated with a variety of activities, card games and other forms of play.

BACKGROUND OF THE INVENTION

Many games and sports require the keeping of a score or the exhibiting of numerical information to assist in or to enhance the activity. Score-pads and score-cards are common means to achieve this. The use of a series of flip cards with preprinted numerals may also provide a changing score or point count as is taught by Degirmence in U.S. Pat. No. 8,607,725. This invention is too large to be easily carried and too cumbersome to be placed on a game table. However, a simple mechanical device may make the necessary numerals easier to exhibit and easier to change as a point count changes during play. A small mechanical numerical display device may be especially helpful in the card game entitled "Magic the Gathering®" where a changing display of two numerals is essential to the game. There is a need for a simple, small portable numerical display device wherein the display can be easily changed as needed throughout play without detracting from the game or taking up table space.

BRIEF SUMMARY OF THE INVENTION

The present invention provides a numerical display device with the capacity to exhibit one or more numerals that can easily be changed as often as needed throughout the course of play. The device is small, portable and may be carried on the person and set on a table without encumbering the game or the players in any manner.

It is an object of the present invention to provide a counting and scoring device that exhibits two rotating wheels on which are displayed the numerals 0 to 9 which can be easily and independently rotated to present any combination of two numerals.

It is another object of the present invention to have a small, compact, portable counting device that can be easily carried.

It is a still further object of the present invention to have a counting device that can be set on a playing table and not interfere with the play while displaying the necessary numerical information kept current as the play proceeds.

It is another object of the present invention to have the rotating wheels of the device rotatable with one hand while the other may be engaged in play and the device remains stationary on the playing surface.

The present invention is a counting and scoring device that comprises a housing having an interior and an exterior, a horizontal base, substantially vertical front and rear walls, and a substantially flat upper surface, the walls being coextensive with the base and with the upper surface, and a central vertical partition dividing the interior of the housing into a right and a left chamber, the partition having an upper opening and a lower opening in vertical alignment along a median of the partition. There is a lateral extension projecting from each side of the front and rear walls defining a viewing window with the upper surface on each side of the housing and a right wheel rotatably and vertically mounted within the right chamber and a left wheel rotatably and vertically mounted within the left chamber, the right wheel and the left wheel having a plurality of flat outer surfaces on which to exhibit indicia, and the right wheel and the left wheel further comprise a segmented raised rim about an outer edge to form a turning surface. The wheels have an inward facing wall having a plurality of depressions which are substantially in the shape of a segment of a sphere, arranged in a circle and oriented so that there is one depression corresponding to each flat outer surface of the wheel, an outward facing hub portion, and a central opening through the inward facing wall in communication with the outward facing hub portion, the central opening in the outward facing hub portion of the right wheel being dimensioned to accept a threaded bolt such that the right wheel can rotate on the bolt, the central opening in the outward facing hub portion of the left wheel being dimensioned to accept a hexagonal nut such that the hexagonal nut cannot rotate within the hub portion. The threaded bolt is dimensioned to extend through the right wheel, the lower opening in the central partition, and the left wheel to cooperate with the hexagonal nut. There is also a compression spring and two ball bearings dimensioned to be contained within the upper opening in the partition, one ball bearing situated on each side of the compression spring, such that the compression spring urges the ball bearings outward on each side of the partition to cooperate with the depressions in the inward facing walls of the wheels, and a chamber within a lower portion of the housing. When the threaded bolt is extended through the hub portion of the right wheel, the central opening in the inward facing wall of the right wheel, the lower opening in the partition, the central opening in the inward facing wall of the left wheel and the hub portion of the left wheel to cooperate with the hexagonal nut, the right wheel and the left wheel are rotatably and vertically maintained in spaced relation to the partition and the ball bearings are disposed within the depressions in the inward facing walls of the wheels so that when the wheels are rotated the ball bearings are moved from one depression to the next, a clicking sound is heard, and the corresponding indicia is centered in the viewing window.

The present invention is also a counting and scoring device that comprises a housing having an interior and an exterior, a horizontal base, substantially vertical front and rear walls, and a substantially flat upper surface, the walls being coextensive with the base and with the upper surface, and a central vertical partition dividing the interior of the housing into a right chamber and a left chamber, the partition being coextensive with the base, the upper surface, the front wall and the rear wall. There are two openings vertically aligned along a median of the partition and extending through it, an upper opening and a lower opening. Lateral extensions project from each side of the front and rear walls to define a viewing window with the upper surface on each side of the housing. A right wheel is rotatably and vertically mounted within the right chamber of the housing and defines a right exterior of the device and a left wheel is rotatably and vertically mounted within the left chamber of the housing and defines a left exterior of the device, the right wheel and the left wheel comprise ten equivalent flat outer surfaces on which to exhibit indicia such that the wheels are in the form of a regular decagon in cross section. The right wheel and the left wheel further comprise an outward facing open hub portion, an inward facing wall, and a central opening extending through the hub portion and the inward facing wall, and the inward facing wall having ten evenly spaced depressions arranged in a circle, one disposed below each flat outer surface, the depressions being substantially in the shape of a segment of a sphere and situated to cooperate with the upper opening in the partition. There are two ball bearings and a compression spring disposed within the upper opening in the partition, one ball bearing on each side of the compression spring, the compression spring to urge the ball bearings outward of the upper opening on each side of the partition and into the depressions in the inward facing wall of the right wheel and the left wheel so that when the wheels are rotated the ball bearings move from one depression to the next and the corresponding indicia on the flat outer surfaces of the wheels is centered within the viewing windows. There is also means for rotatably and vertically mounting the right wheel and the left wheel within the housing. When the inward facing walls are held in spaced relation to the partition to enable the ball bearings to enter the successive depressions in the inward facing walls a clicking sound is heard as the wheels are rotated.

The present invention can also be described as a counting and scoring device that comprises a housing having an interior and an exterior, a horizontal base, substantially vertical front and rear walls, a substantially flat upper surface, the walls being coextensive with the base and with the upper surface, and a central vertical partition dividing the interior of the housing into a right chamber and a left chamber. The partition is coextensive with the base, the upper surface, the front wall and the rear wall, and the partition has two openings vertically aligned along a median, an upper opening and a lower opening. There is a right wheel rotatably and vertically mounted within the right chamber which defines a right exterior of the device and a left wheel rotatably and vertically mounted within the left chamber which defines a left exterior of the device, the right wheel and the left wheel being in the form of a regular decagon in cross section and having ten equivalent flat outer surfaces on which to exhibit indicia. There is a lateral extensions projecting from each side of the front and rear walls to define a viewing window with the upper surface on each side of the housing through which to view the indicia on the flat outer surfaces and means for rotatably and vertically mounting the right wheel and the left wheel within the housing. There are also means for maintaining the right wheel and the left wheel in spaced relation to the partition, means for manually rotating the right wheel and the left wheel, and a chamber within a lower portion of the housing, the chamber containing a weight.

Other features and advantages of the invention will be seen from the following description and drawings.

DETAILED DESCRIPTION OF THE INVENTION

Figure 1:
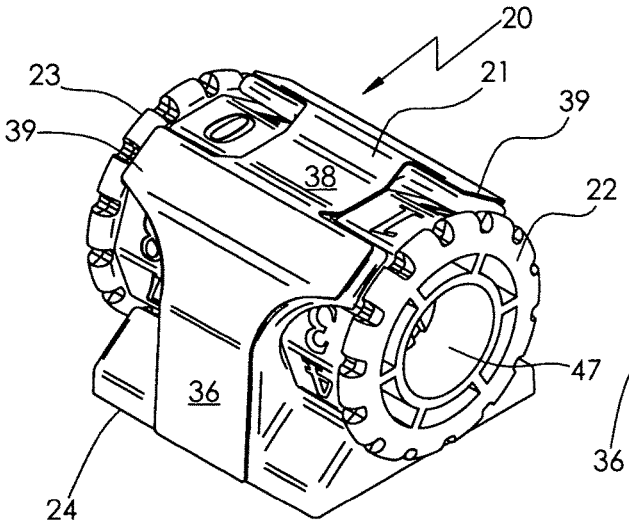
FIG. 1 is a right perspective view of the counting and scoring device of the present invention.
Figure 2:
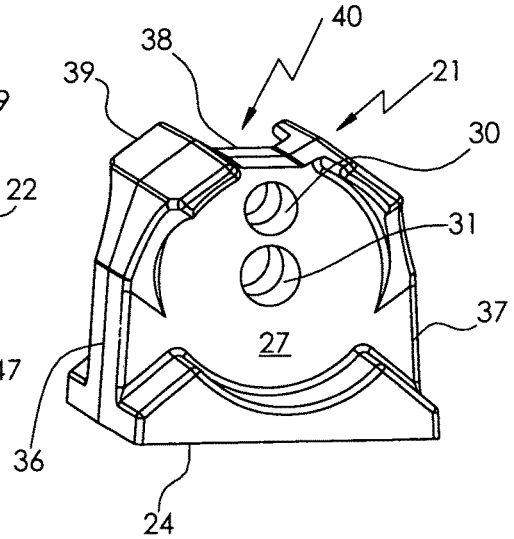
FIG. 2 is perspective view of the housing.
Figure 17:
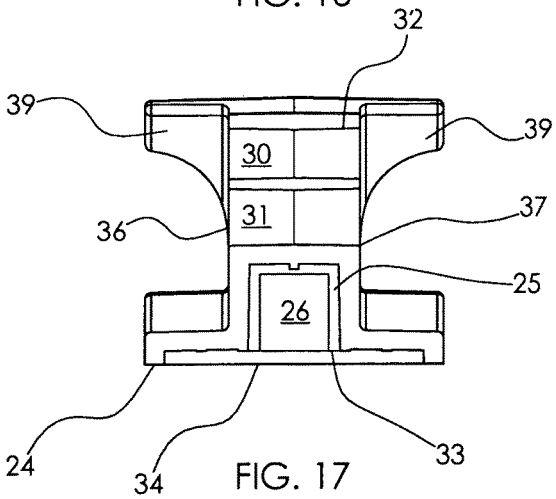
FIG. 17 is a schematic view of the inside of the housing.

The device 20 of the present invention may be made up of a housing configured to contain one or more rotatably affixed wheels. A typical embodiment as seen in FIG. 1 may have two wheels, each exhibiting the numerals 0 through 9. The housing 21 for this embodiment, as may be seen in FIG. 2, may have a substantially horizontal base 24. There may be a small open chamber 25 in the lower area of the housing 21 into which may be placed a weight 26, which may be optional. The chamber 25 may only be accessible through an opening 33 through the base 24 as illustrated in FIG. 17. A cover 34 substantially the size of the base may conceal the chamber 25 and may retain the weight, if used. The cover 34 may have a soft non-skid surface so the device 20 may not mar a playing surface and may remain in place during play. The cover 34 may be affixed to the base 24 by any common adhesive known in the art.

There may be a central vertical partition 27 within the housing 21 separating the interior into a right chamber 28 and a left chamber 29. Two circular openings, an upper opening 30 and a lower opening 31, may be located along the median of the partition 27. Both openings may extend completely through the partition 27. The cylindrical wall 32 of the upper opening 30 may taper slightly toward the center from both sides. This may be seen in FIG. 16 and will be explained below. The lower opening 31 may be at the substantial midpoint of the partition 27 and may have a straight cylindrical interior wall. The housing 21 may contain a right wheel 22 disposed in the right chamber 28, and a left wheel 23 disposed in the left chamber 29, both oriented such that a central opening 35 in each wheel 22, 23 may communicate with the lower opening 31 in the housing partition 27.

There may be a front surface 36 and a rear surface 37 of the housing 21 which may extend upward from and be coextensive with the base 24 and with a substantially flat upper surface 38. The upper surface 38 may be used to display indicia if desired. Lateral extensions 39 from both sides of the front 36 and rear 37 surfaces may form a three-sided viewing window 40 with the sides of the upper surface 38 on each side of the housing 21.

The two wheels 22, 23 may be alike except for their outside portions which will be described below. The wheels 22, 23 may be substantially circular with a thickness sufficient to display numerals on their outer surfaces. The outer surfaces may be in the form of ten equivalent flat areas such that the wheels 22, 23 may be a regular decagon in cross section. This configuration may provide ten flat surfaces 41 on each wheel 22, 23 on which to place the numerals 0 to 9. Any other configuration may be used depending upon the number and type of indicia to be displayed on the wheels.

The outward facing hub portion of the wheels 22, 23 may be substantially open and there may be a wall 42 on the inside of each wheel facing the partition 27 when the wheels are mounted. The walls 42 may have a central opening 35 which may communicate with the lower opening 31 in the housing partition 27. The surfaces of the walls 42 may have a series of depressions 43 in the shape of a segment of a sphere. The depressions 43 being situated equidistantly below the substantial center line of each flat outer surface 41 of each wheel 22, 23 thereby forming a circle of depressions 43 around both walls 42. The series of depressions 43 may be disposed to cooperate with the upper opening 30 in the housing partition 27 as the wheels are rotated. A raised rim 46 may be situated about the outer edge of each wheel 22, 23, and may be segmented to form a turning surface to facilitate rotating the wheels 22, 23. See FIGS. 6 through 13.

The hub portion of the right wheel 22 may be in the form of a circular cavity 47 in communication with the central opening 35 in the wall 42. The hub portion of the left wheel 23 may have a hexagonal cavity 48 in communication with the central opening 35 in the wall 42.

Figure 3:
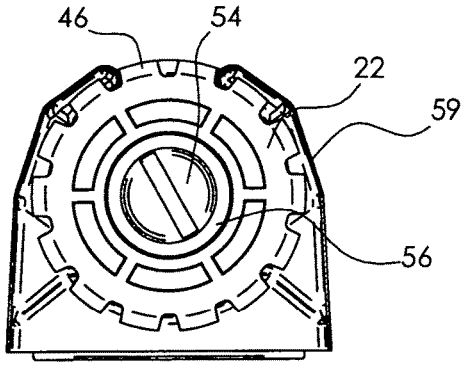
FIG. 3 is a right plan view of the device.
Figure 4:
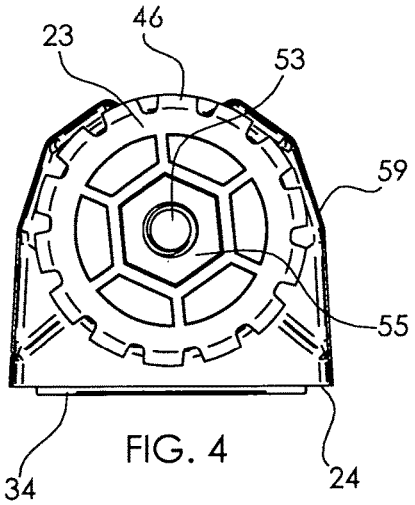
FIG. 4 is a left plan view of the device.
Figure 5:
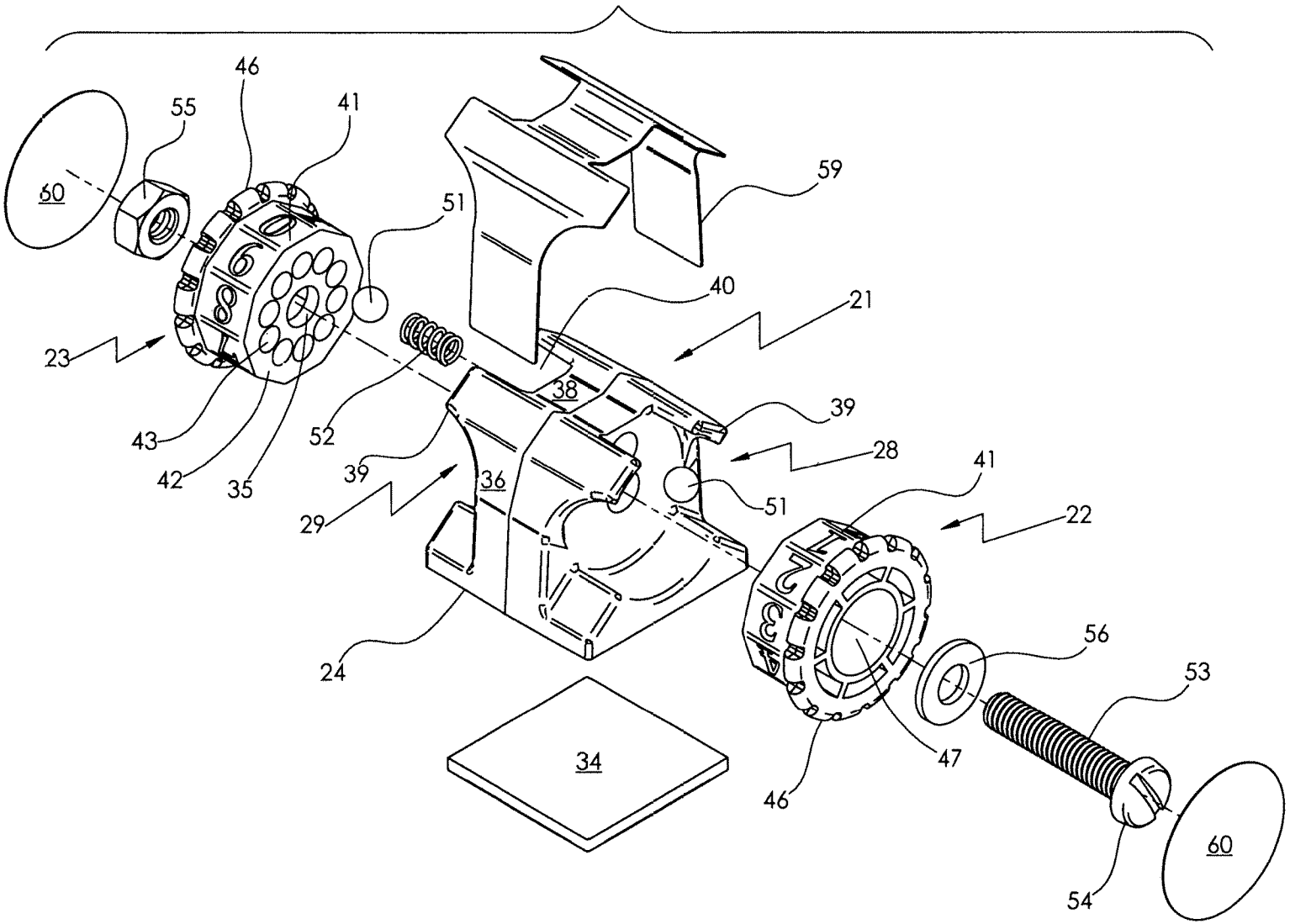
FIG. 5 is an exploded view of the device.
Figure 6:
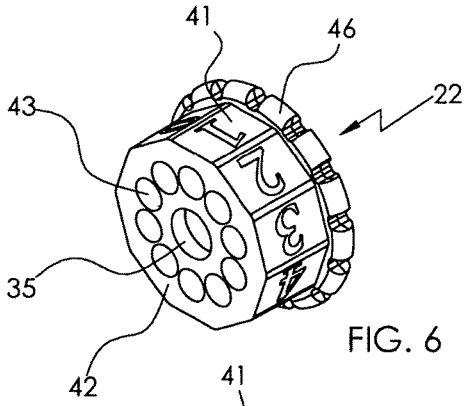
FIG. 6 is a perspective view of the inside of the right wheel.
Figure 10:
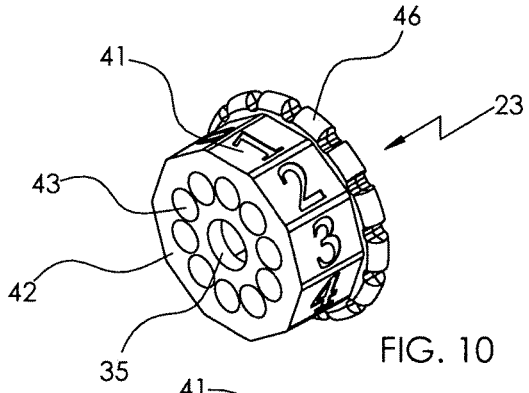
FIG. 10 is a perspective view of the inside of the left wheel.
Figure 7:
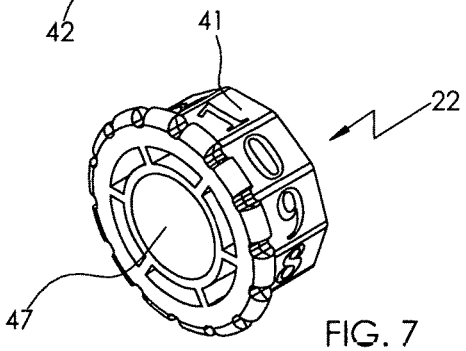
FIG. 7 is a perspective view of the outside of the right wheel.
Figure 11:
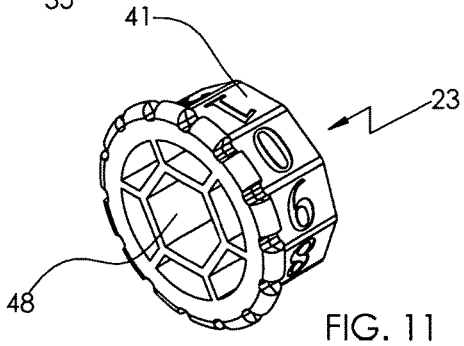
FIG. 11 is a perspective view of the outside of the left wheel.
Figure 8:
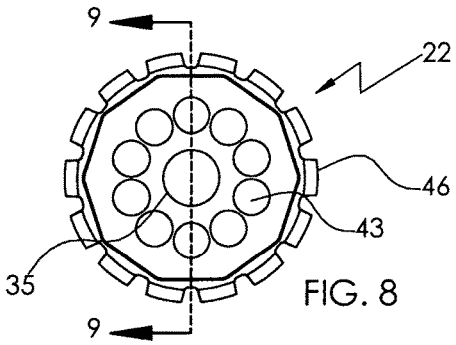
FIG. 8 is a plan view of the inside of the right wheel.
Figure 12:
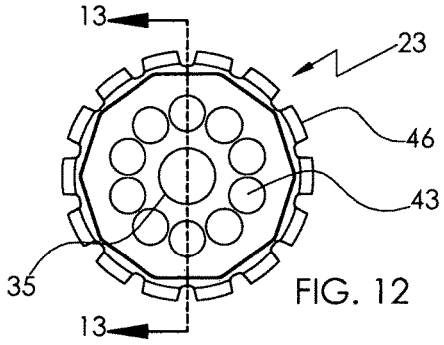
FIG. 12 is a plan view of the inside of the left wheel.
Figure 9:
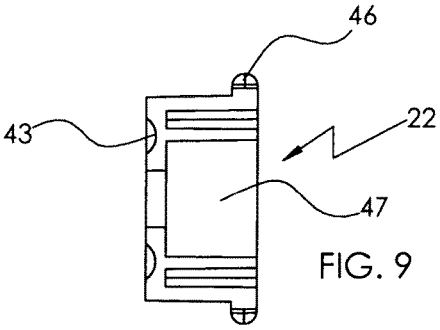
FIG. 9 is a cross-section through line 9-9 of FIG. 8.
Figure 13:
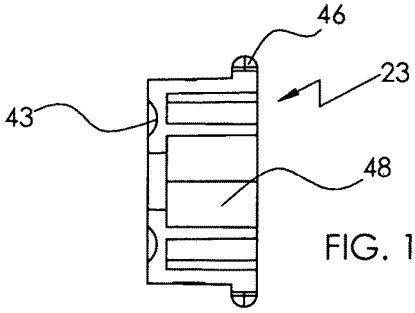
FIG. 13 is a cross-section through line 13-13 of FIG. 12.
Figure 15:
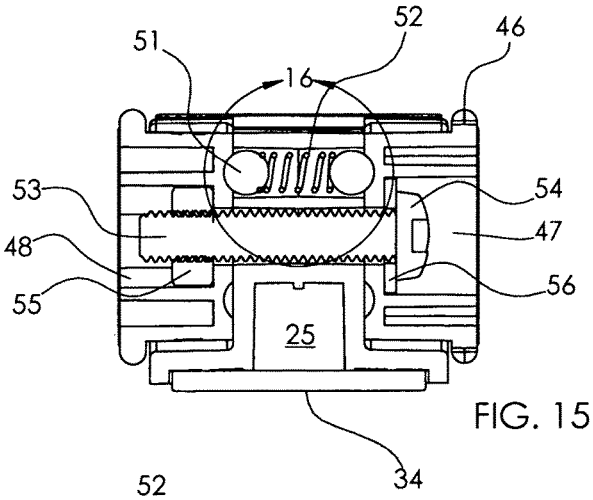
FIG. 15 is a cross-section through line 15-15 of FIG. 14.
Figure 16:
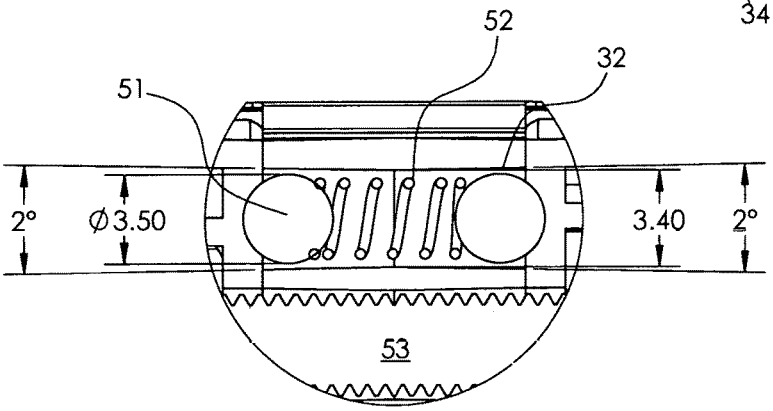
FIG. 16 is a close-up view of the area designated 16 in FIG. 15.

Also disposed within the housing may be two ball bearings 51 and a compression spring 52, seen in FIGS. 5, 15 and 16. A threaded bolt 53 of sufficient length to extend through the left wheel 23, the housing partition 27 and the right wheel 22, and a hexagonal nut 55 may be used to rotatably mount the wheels 22, 23 to the housing 21. The circular cavity 47 in the right wheel 22 may accept the head 54 of the threaded bolt 53. A washer 56 may be used between the head 54 of the threaded bolt 53 and the surface of the wheel wall 42 within the circular cavity 47 to prevent wear on the surface. The shank of the threaded bolt 53 may extend into the circular cavity 47 and through the central opening 35 in the right wheel 22, the lower opening 31 in the housing partition 27, the central opening 35 in the left wheel 23 and into the hexagonal cavity 55 in the left wheel. The walls of the hexagonal cavity 48 in the left wheel 23 may be configured to accept the hexagonal nut 55 such that the hexagonal nut 55 cannot rotate within the hexagonal cavity 48. These structures may be seen in FIGS. 3, 4, and 5.

To assemble the device 20 the housing 21 may be turned so that the left chamber 29 is facing upward. One ball bearing 51 may be placed into the upper opening 30 in the housing partition 27. The ball bearing 51 will not pass all the way through the upper opening 30 because of the tapering inward of the inside wall 32. The left wheel 23 may be placed into left chamber 29 of the housing 21 and aligned so that the central opening 35 in the wheel 23 is in communication with the lower opening 31 in the housing partition 27. The hexagonal nut 55 may then be placed into the hexagonal cavity 48 so that it may rest against the wall 42 and be held securely by the hexagonal configuration of the cavity 48.

The left wheel 23 may be held in place using one or more fingers while maintaining the hexagonal nut 55 within the hexagonal cavity 48, and the housing 21 turned over so that the right chamber 29 may be facing upward. The compression spring 52, sized to pass through the inward tapered interior wall 32, may be placed into the upper opening 30 to come in contact with the ball bearing 51 previously placed into the left side and maintained in opening 30 by the proximity of the left wheel 23. The second ball bearing 51 may then be placed into the upper opening 30 from the right chamber 28. The compression spring 52 may exert sufficient force on both ball bearings 51 so they are situated partially outside the upper opening 30 on both sides of the housing partition 27.

The right wheel 22 may then be placed into the right chamber 28 aligning the central opening 35 with the lower opening 31 in the partition 27. The washer 56 may be placed into the circular cavity 47 in the right wheel 22, followed by the insertion of the threaded bolt 53 and extending it through the central opening 35 in the right wheel 22, the lower opening 31 in the housing partition 27 and through the central opening 35 in the left wheel 23 and into the hexagonal cavity 48.

Holding the right wheel 22 close to the housing partition 27, the threaded bolt 53 may be rotated using a screw driver or a finger, until the bolt 53 is in cooperation with the hexagonal nut 55. At this point, with the bolt 53 held fast, the left wheel 23 may be rotated, as a wrench, and with it the hexagonal nut 55, until the two wheels 22, 23 are firmly mounted within the housing 21. The wheels 22, 23 may be in spaced relation on both sides of the housing partition 27 so that the ball bearings 51 on each side of the partition 27 may be disposed within one of the depressions 43 in the walls 32 of each wheel 22, 23. At this point the wheels may be independently rotated and a clicking sound may be heard as the ball bearings 51 pass from one depression 43 to the next urged by the compression spring 52. As the click is heard, a flat surface 41 of the wheel with a numeral on it will be centered within the three-sided window 40.

Figure 14:
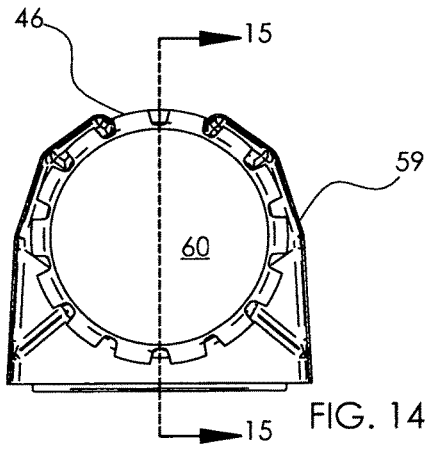
FIG. 14 is a plan view of the right side of the device with decal covers in place.

Decals or other form of cover may be placed over the exterior surfaces of the device 20 and may also be utilized to place the desired numerals on the flat surfaces 41 of each wheel. The decals on the exterior of the device 20 may be for decoration, advertisement, or game enhancement. Typical shapes of such decals may be in a contoured shape 59 to cover the entire exterior surface of the housing 21 and round 60 to cover the exterior of each wheel 22, 23. These may be seen in FIGS. 5 and 14. Other shapes may be utilized according to the indicia to be displayed.

In the embodiment described and illustrated herein the ball bearings 51 may be 3.5 mm in diameter and the compression spring 52 may be 3.4 mm in diameter so the spring may pass through the upper opening 30 in the housing partition 27 and the ball bearings may be placed into the openings but will not pass all the way through. This configuration may facilitate the assembly of the device 20 as described in detail above and may be seen in FIGS. 15 and 16.

The device 20 of the present invention may be made of any rigid material. An injection molded polymeric material may be ideal for this purpose. The material chosen may be sufficiently strong so that repeated rotation of the wheels and movement of the ball bearings will not create wear on the partition or the wheels.

While one embodiment of the present invention has been illustrated and described in detail, it is to be understood that this invention is not limited thereto and may be otherwise practiced within the scope of the following claims.

I claim:

1. A counting and scoring device comprising:

a housing having an interior and an exterior, a horizontal base, substantially vertical front and rear walls, and a substantially flat upper surface, said walls being coextensive with said base and with the upper surface, and a central vertical partition dividing the interior of the housing into a right and a left chamber, said partition having an upper opening and a lower opening in vertical alignment along a median of said partition;

lateral extensions projecting from each side of the front and rear walls defining a viewing window with the upper surface on each side of the housing;

a right wheel rotatably and vertically mounted within the right chamber and a left wheel rotatably and vertically mounted within the left chamber, said right wheel and said left wheel having a plurality of flat outer surfaces on which to exhibit indicia;

said right wheel and said left wheel further comprising:

a segmented raised rim about an outer edge to form a turning surface, an inward facing wall having a plurality of depressions, said depressions being substantially in the shape of a segment of a sphere, arranged in a circle and oriented so that there is one depression corresponding to each flat outer surface of the wheel, an outward facing hub portion, and a central opening through the inward facing wall in communication with the outward facing hub portion;

the central opening in the outward facing hub portion of said right wheel being dimensioned to accept a threaded bolt such that the right wheel can rotate thereon;

the central opening in the outward facing hub portion of said left wheel being dimensioned to accept a hexagonal nut such that the hexagonal nut cannot rotate therewithin;

said threaded bolt being dimensioned to extend through the right wheel, the lower opening in the central partition, and the left wheel to cooperate with the hexagonal nut;

a compression spring and two ball bearings dimensioned to be contained within the upper opening in the partition, one ball bearing situated on each side of the compression spring, such that the compression spring urges the ball bearings outward on each side of the partition to cooperate with the depressions in the inward facing walls of the wheels; and a chamber within a lower portion of the housing;

whereby when the threaded bolt is extended through the hub portion of the right wheel, the central opening in the inward facing wall of the right wheel, the lower opening in the partition, the central opening in the inward facing wall of the left wheel and the hub portion of the left wheel to cooperate with the hexagonal nut the right wheel and the left wheel are rotatably and vertically maintained in spaced relation to the partition and the ball bearings are disposed within the depressions in the inward facing walls of the wheels so that when the wheels are rotated the ball bearings are moved from one depression to the next, a clicking sound is heard, and the corresponding indicia is centered in the viewing window.

2. A counting and scoring device as described in claim 1 further comprising an opening in the base through which to access the chamber.

3. A counting and scoring device as described in claim 2 further comprising a cover substantially the size of the base, said cover concealing the opening in the base and the chamber.

4. A counting and scoring device as described in claim 3 wherein the cover has a soft non-skid outer surface.

5. A counting and scoring device as described in claim 1 further comprising a weight disposed within said chamber.

6. A counting and scoring device as described in claim 1 wherein the plurality of flat outer surfaces on the right wheel and the left wheel number ten and are disposed such that the wheels exhibit a regular decagon in cross section.

7. A counting and scoring device comprising:

a housing having an interior and an exterior, a horizontal base, substantially vertical front and rear walls, and a substantially flat upper surface, said walls being coextensive with said base and with the upper surface, and a central vertical partition dividing the interior of the housing into a right chamber and a left chamber, said partition being coextensive with said base, said upper surface, said front wall and said rear wall;

two openings vertically aligned along a median of the partition and extending therethrough, an upper opening and a lower opening;

lateral extensions projecting from each side of the front and rear walls to define a viewing window with the upper surface on each side of the housing;

a right wheel rotatably and vertically mounted within the right chamber of the housing and defining a right exterior of said device and a left wheel rotatably and vertically mounted within the left chamber of the housing and defining a left exterior of the device, said right wheel and said left wheel comprising ten equivalent flat outer surfaces on which to exhibit indicia such that said wheels are in the form of a regular decagon in cross section;

said right wheel and said left wheel further comprising an outward facing open hub portion, an inward facing wall, and a central opening extending through the hub portion and the inward facing wall, and said inward facing wall having ten evenly spaced depressions arranged in a circle, one disposed below each flat outer surface, said depressions being substantially in the shape of a segment of a sphere and situated to cooperate with the upper opening in the partition;

two ball bearings and a compression spring disposed within the upper opening in the partition, one ball bearing on each side of the compression spring, said compression spring to urge the ball bearings outward of the upper opening on each side of the partition and into the depressions in the inward facing wall of the right wheel and the left wheel so that when the wheels are rotated the ball bearings move from one depression to the next and the corresponding indicia on the flat outer surfaces of the wheels is centered within the viewing windows; and means for rotatably and vertically mounting the right wheel and the left wheel within the housing;

whereby the inward facing walls are held in spaced relation to the partition to enable the ball bearings to enter the successive depressions in the inward facing walls and a clicking sound is heard as the wheels are rotated.

8. A counting and scoring device as described in claim 7 wherein the means for rotatably and vertically mounting the right wheel and the left wheel within the housing comprises a threaded bolt dimensioned for insertion into the hub portion of the right wheel and extending through the right wheel, the lower opening in the partition, and the left wheel, and a nut threaded to cooperate with the threaded bolt and disposed within the hub portion of the left wheel.

9. A counting and scoring device as described in claim 8 wherein the hub portion of the left wheel is dimensioned to accept and cooperate with the nut such that the nut cannot rotate therewithin.

10. A counting and scoring device as described in claim 8 further comprising decal covers dimensioned to fit over the right exterior and the left exterior to conceal a head of the threaded bolt and the nut.

11. A counting and scoring device comprising:

a housing having an interior and an exterior, a horizontal base, substantially vertical front and rear walls, a substantially flat upper surface, said walls being coextensive with said base and with the upper surface, and a central vertical partition dividing the interior of the housing into a right chamber and a left chamber, said partition being coextensive with said base, said upper surface, said front wall and said rear wall, and said partition having two openings vertically aligned along a median thereof, an upper opening and a lower opening;

a right wheel rotatably and vertically mounted within the right chamber and defining a right exterior of said device and a left wheel rotatably and vertically mounted within the left chamber and defining a left exterior of the device, said right wheel and said left wheel being in the form of a regular decagon in cross section and having ten equivalent flat outer surfaces on which to exhibit indicia;

lateral extensions projecting from each side of the front and rear walls to define a viewing window with the upper surface on each side of the housing through which to view the indicia on the flat outer surfaces;

means for rotatably and vertically mounting the right wheel and the left wheel within the housing;

means for maintaining the right wheel and the left wheel in spaced relation to the partition;

means for manually rotating the right wheel and the left wheel; and a chamber within a lower portion of the housing, said chamber containing a weight.

* * * * *